US006415624B1

(12) United States Patent
Connors et al.

(10) Patent No.: US 6,415,624 B1
(45) Date of Patent: Jul. 9, 2002

(54) DRINKING BOTTLE HAVING A SEPARATE THERMALLY REGULATING CONTAINER

(76) Inventors: Frank R. Connors; Caroline Connors, both of 8 Washington Dr., East Quogue, NY (US) 11942

( * ) Notice: Subject to any disclaimer, the term of this patent is extended or adjusted under 35 U.S.C. 154(b) by 0 days.

(21) Appl. No.: 09/650,099

(22) Filed: Aug. 25, 2000

(51) Int. Cl.[7] ..... F25D 3/08

(52) U.S. Cl. ..... 62/457.3; 62/530

(58) Field of Search ..... 62/457.3, 530

(56) References Cited

U.S. PATENT DOCUMENTS

| | | | | | |
|---|---|---|---|---|---|
| 4,165,812 | A | * | 8/1979 | Jennison | 215/10 |
| 4,485,636 | A | * | 12/1984 | Hilado | 62/430 |
| 5,379,886 | A | | 1/1995 | Bruaner et al. | 206/216 |
| 5,467,877 | A | * | 11/1995 | Smith | 215/11.1 |
| 5,655,384 | A | * | 8/1997 | Joslin, Jr. | 62/294 |
| 5,664,671 | A | * | 9/1997 | Nedblake, Jr. | 206/217 |
| 6,062,380 | A | * | 5/2000 | Dorney | 206/217 |
| 6,092,648 | A | * | 6/2000 | Sellars | 206/221 |
| 6,123,065 | A | * | 9/2000 | Teglbjarg | 126/263.09 |
| 6,145,685 | A | * | 11/2000 | Dick | 220/23.88 |
| 6,173,833 | B1 | | 1/2001 | Strehlow | 206/216 |
| 6,206,218 | B1 | * | 3/2001 | Young et al. | 220/23.4 |

* cited by examiner

*Primary Examiner*—William C. Doerrler
*Assistant Examiner*—Mark Shulman
(74) *Attorney, Agent, or Firm*—Darby & Darby

(57) ABSTRACT

A thermally-regulated bottle has a generally cylindrical body portion defining a first chamber for containing a drinking fluid and defining a central longitudinal axis. A passage is provided for accessing the drinking fluid. A secondary thermal-regulating container contains a thermal-regulating material, such as ice water, or heated water. According to a first embodiment of the invention, the bottle includes a recess which is positioned generally parallel to and remote from the central longitudinal axis, along the side of the bottle. The recess being sized and shaped to selectively receive the secondary thermal-regulating container so that the thermal-regulating material may thermally interact with the drinking fluid located within the chamber and either keep the drinking fluid heated or chilled with respect to the ambient temperature for a prolonged period of time. According to a second embodiment of the invention, the bottle includes a centrally located chamber which is sized and shaped to snugly receive the secondary container from an access opening located at the bottom of the bottle. Regardless of the arrangement, the heated or chilled material of the secondary container thermally reacts with the drinking fluid of the bottle and maintains either a chilled or heated temperature, as desired.

12 Claims, 5 Drawing Sheets

DRINKING BOTTLE HAVING A SEPARATE THERMALLY REGULATING CONTAINER

BACKGROUND OF THE INVENTION a) Field of the Invention

This invention relates generally to the field of drinking vessels, and more particularly to specialized vessels used to contain a drinking fluid and which include an isolated thermal regulating element to help maintain a desired temperature of the drinking fluid.

b) Description of Prior Art

Generally, all beverages today are packaged in either cardboard cartons, plastic or glass bottles, or metal cans (e.g., steel or aluminum), in amounts that are suitable for an individual to consume. Typically, the consumer will chill the beverage in a refrigerator prior to consuming it. If the consumer removes a chilled beverage from refrigeration, the beverage will immediately begin to absorb heat from the surrounding environment until eventually the beverage becomes thermally equilibrated with the ambient temperature. Of course, if the ambient temperature is colder than then the operating temperature of the refrigerator, the removed beverage will loose more heat to the colder surrounding environment, again until thermal equilibrium is reached.

Thermal equilibration between the beverage and the ambient temperature will be reached in a period of time depending on several factors, including the initial chilled temperature of the beverage, the temperature of the surrounding environment (i.e., ambient), the particulars of the environment (e.g., direct sunlight, humidity, and/or wind), and the type of material used to contain the beverage (e.g., a cardboard container may resist heat transfer better than an aluminum can), and the presence of local heat generating (e.g., electric heater), or heat absorbing (e.g., ice) elements.

Of course, it is possible to slow down the process of thermal transfer from the surrounding environment to the beverage by placing the beverage in a cooler filled with ice, or surrounding the beverage container with an insulative jacket, such as a "koolie" which is usually made from a foam-rubber material. Although such devices are generally useful at prolonging a chilled (or heated) temperature of a beverage, these devices are generally cumbersome to carry and difficult to use.

It is therefore an object of the present invention to provide an improved drinking bottle having a thermal regulating element, which overcomes the deficiencies of the prior art.

It is therefore an object of the present invention to provide a thermally efficient container that prolongs a desired temperature (chilled or heated) of a beverage.

It is another object of the invention to provide such a container that is easy to use and portable to transport.

SUMMARY OF THE INVENTION

A thermally-regulated bottle has a generally cylindrical body portion defining a first chamber for containing a drinking fluid and defining a central longitudinal axis. A passage is provided for accessing the drinking fluid. A secondary thermal-regulating container contains a thermal-regulating material, such as ice water, or heated water.

According to a first embodiment of the invention, the bottle includes a recess which is positioned generally parallel to and remote from the central longitudinal axis, along the side of the bottle. The recess being sized and shaped to selectively receive the secondary thermal-regulating container so that the thermal-regulating material may thermally interact with the drinking fluid located within the chamber and either keep the drinking fluid heated or chilled with respect to the ambient temperature for a prolonged period of time.

According to a second embodiment of the invention, the bottle includes a centrally located chamber which is sized and shaped to snugly receive the secondary container from an access opening located at the bottom of the bottle.

Regardless of the arrangement, the heated or chilled material of the secondary container thermally reacts with the drinking fluid of the bottle and maintains either a chilled or heated temperature, as desired.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description of illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other similar structures, methods and systems for carrying out the several proposes of the present invention. It is important, therefore, that the claims be regarded as including such equivalent constructions in so as they do not depart from the spirit and scope of the present invention.

DETAILED DESCRIPTION OF THE PREFERRED EMBODIMENT

Figure 1:
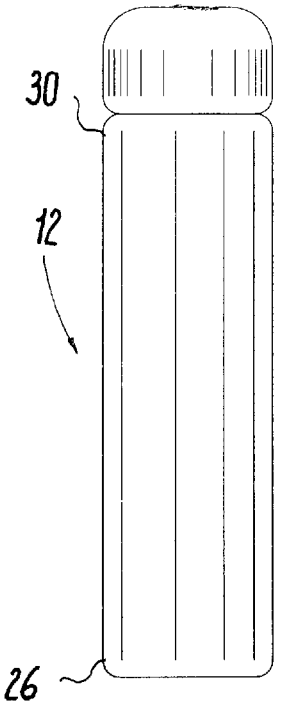
FIG. 1 is a front view of a thermal-regulating container, according to a first embodiment of the present invention.
Figure 2:
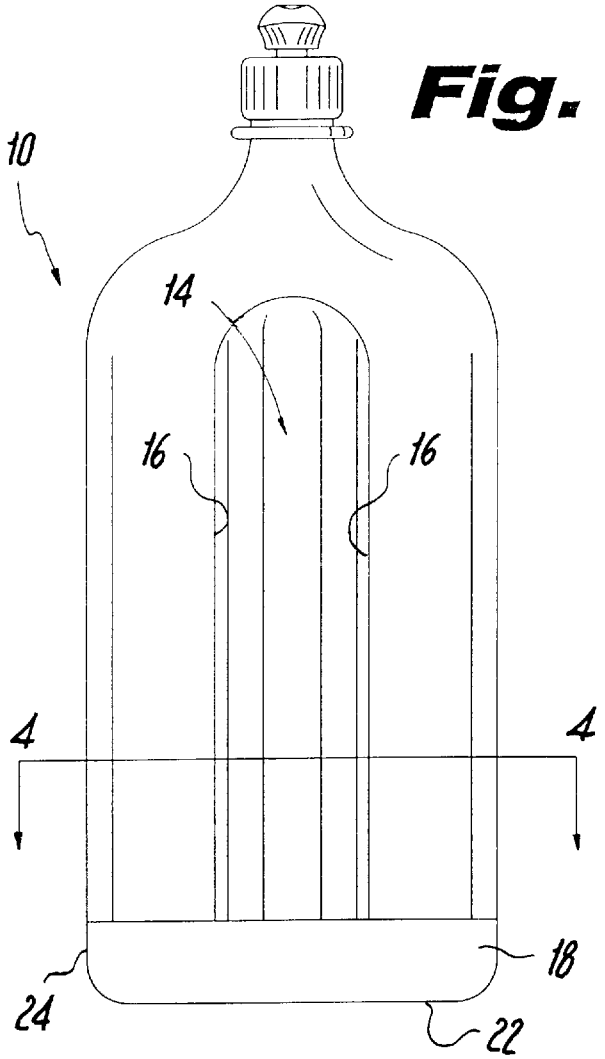
FIG. 2 is a front view of a drinking bottle, showing a recess which is adapted to receive the thermal-regulating container, according to the first embodiment of the invention.
Figure 3:
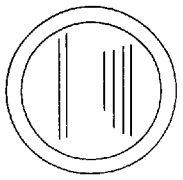
FIG. 3 is a top view of the thermal-regulating container or FIG. 1, according to the first embodiment of the invention.
Figure 4:
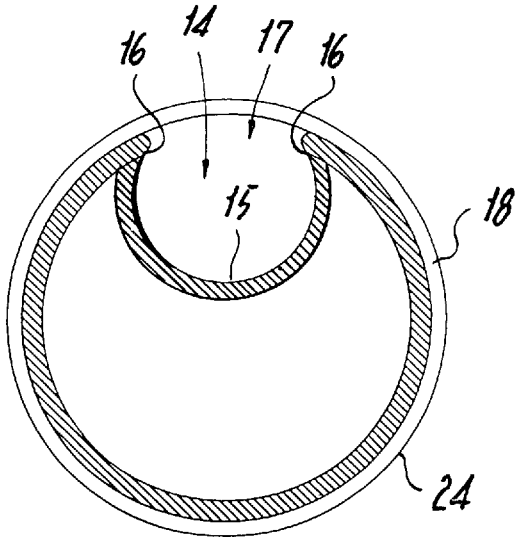
FIG. 4 is a sectional view of the drinking bottle, taken along the line 4—4 of FIG. 2, according to the first embodiment of the invention.

Referring to FIGS. 1–5, a first embodiment of the invention is shown, including a drinking bottle 10, and a secondary temperature-regulating container 12. Bottle 10 is preferably made from a suitable plastic, such as polyethylene terephthalate (PET) and includes an off-center side-accessible recess 14 having an arcuate inside wall surface 15 and defining an access opening 17. Inside wall surface 15 is generally sized and shaped to selectively receive and snugly hold secondary container 12. Recess 14 preferably has a cross-sectional shape which is similar to the cross-sectional shape of secondary container 12 so that when secondary container 12 is located within recess 14, the walls of secondary container 12 snugly contact the inside walls of recess 14. Recess 14 is generally located along the side of bottle 10, parallel to and remote from the longitudinal central axis of bottle 10, as shown in FIGS. 2 and 4.

Secondary container 12 may be any appropriate size and shape, however, it is preferred that secondary container 12 be generally cylindrical and no larger than about ⅓ the size of the bottle 10. The purpose of secondary container 12 is to contain a liquid (or other material) which may be heated or chilled and to thermally maintain a drinking liquid of bottle 10 at a desired temperature for a prolonged period of time. For example, secondary container 12 may contain a liquid that is suitable for freezing, such as water. Once chilled, secondary container 12 is inserted into recess 14, as described below, so that any drinking liquid in bottle 10 may thermally transfer its heat to the chilled secondary container 12, and become chilled, to an equilibrated temperature, similar to putting ice directly into a drink.

Bottle 10 and container 12 may be made from any suitable material using an appropriate manufacturing process, as is generally known by those skilled in the art. Some commonly used manufacturing processes for making similar containers include injection molding and blow-type molding. Other materials suitable for either bottle 10 or secondary container 12 include other flexible or semi-rigid plastics, glass, and metal.

Figure 5:
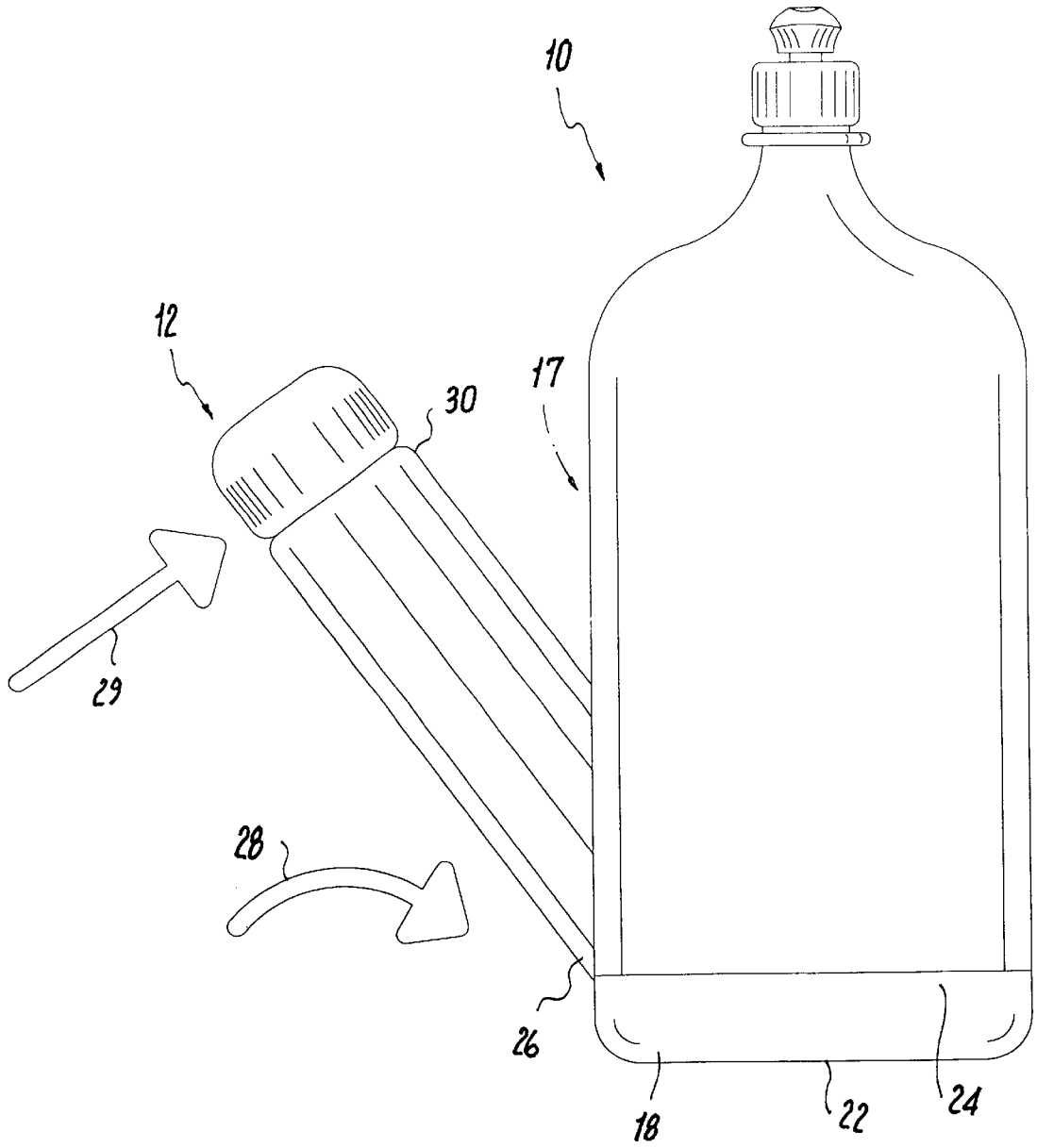
FIG. 5 is a side view of the drinking bottle and the thermal-regulating container, showing the thermal-regulating container being inserted into the recess of the drinking bottle, according to the first embodiment of the invention.
Figure 6:
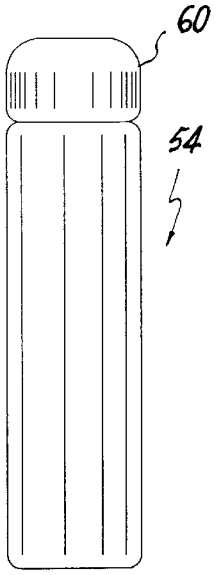
FIG. 6 is a front view of a thermal-regulating container, according to a second embodiment of the present invention.
Figure 8:
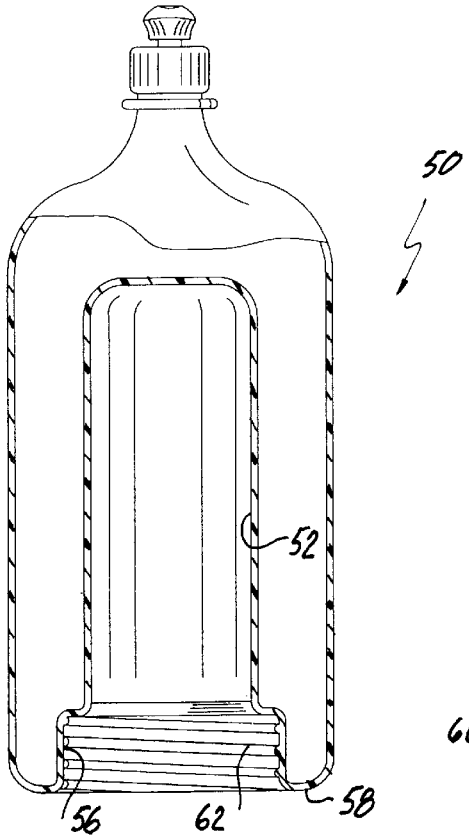
FIG. 8 is a partial sectional front view of a drinking bottle, showing details of a central cavity that is sized and shaped to receive the thermal-regulating container of FIG. 6, according to the second embodiment of the invention.
Figure 10:
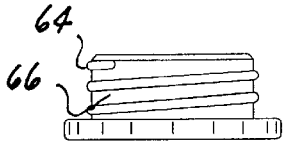
FIG. 10 is a side view of a securing cap used to seal the bottom of the central cavity of the drinking bottle, according to the second embodiment of the invention.
Figure 7:
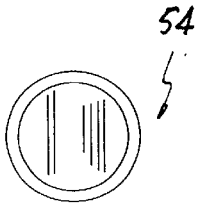
FIG. 7 is a top view of the thermal-regulating container of FIG. 6.
Figure 9:
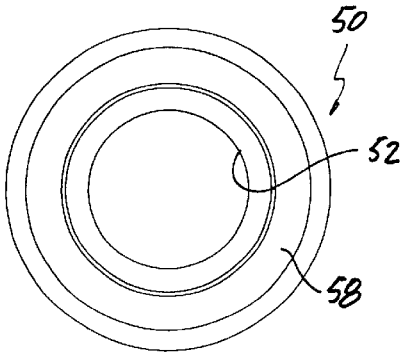
FIG. 9 is a bottom view of the drinking bottle according to the second embodiment of the invention, showing details of an opening to the central cavity.
Figure 11:
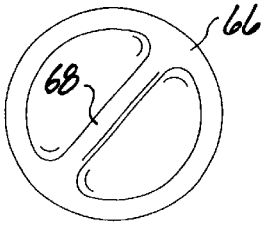
FIG. 11 is a bottom view of the securing cap of FIG. 10.
Figure 12:
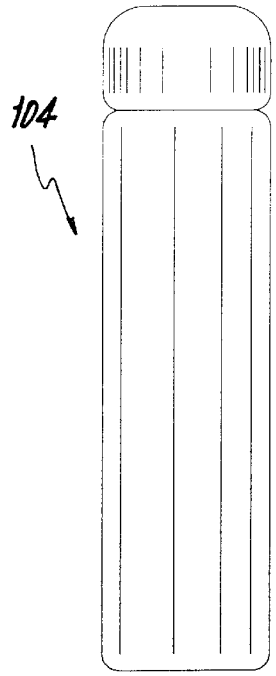
FIG. 12 is a side view of a thermal-regulating container, according to a third embodiment of the present invention.
Figure 14:
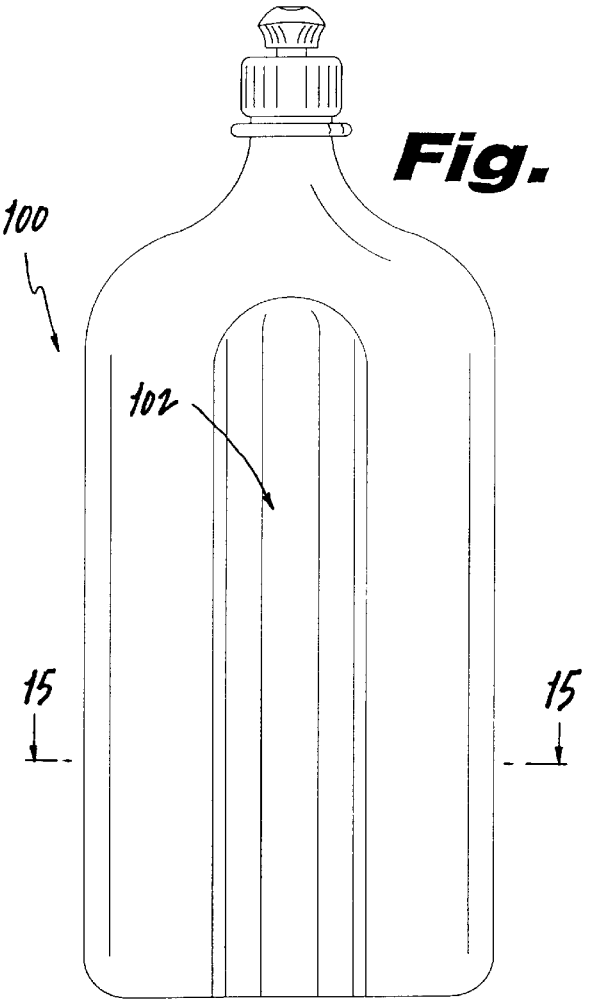
FIG. 14 is a side view of a drinking bottle, showing a recess which is sized and shaped to receive the thermal-regulating container, according to the third embodiment of the invention.
Figure 13:
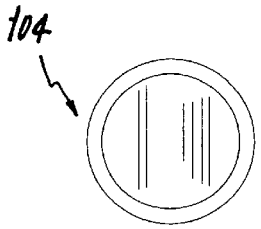
FIG. 13 is a top view of the thermal-regulating container of FIG. 12.
Figure 15:
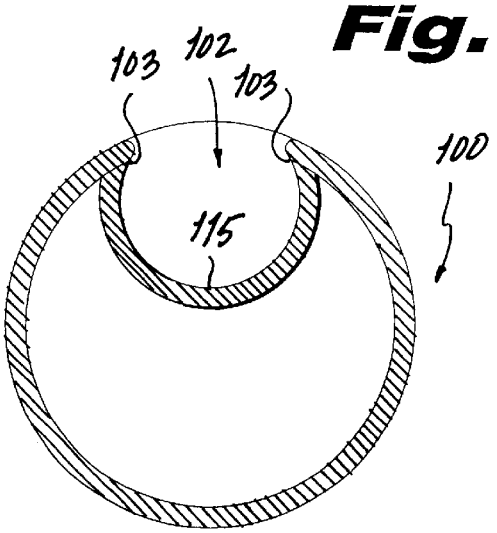
FIG. 15 is a bottom view of the drinking bottle, according to the third embodiment of the invention.

As shown in FIGS. 2, 4, and 5, bottle 10 further includes a cupped base 18 located at a lower end 20 of bottle 10. Base 18 is also made from a plastic and includes a relatively flat bottom 22 and a generally cylindrical side wall 24. Side wall 24 is sized and shaped to snugly receive lower end 20 of bottle 10, as shown in FIGS. 2, 4, and 5. Base 18 is preferably adhered or otherwise attached to lower end 20 of bottle 10 so that a portion of side wall 24 covers a lower end portion of access opening 17 of recess 14. The purpose of base 18 is to protect lower end 20 of bottle 10, and also help retain secondary container 12 within recess 14 of bottle 10.

Referring to FIG. 5, and in accordance with this embodiment of the invention, secondary container 12 is inserted into recess 14 by first positioning a lower end 26 of secondary container 12 through access opening 17 of recess 14 so that lower end 26 of secondary container 12 lies adjacent to bottom 22 of base 18, as illustrated by arrow 28 of FIG. 5. After lower end 26 of secondary container 12 is snugly positioned as shown in FIG. 5, an upper end 30 of secondary container 12 may be pushed through access opening 17 (as illustrated by arrow 29) until secondary container 12 is located entirely within recess 14, snugly contacting side walls 15 of recess 14, and lying generally parallel to the longitudinal axis of bottle 10. The ends 16 of side walls 15 of recess 14 preferably define an access opening 17 having a width that is slightly smaller than the width of secondary container 12 so that the ends 16 of side walls 15 and/or secondary container 12 must temporarily flex and distort during insertion of secondary container 12 into recess 14. Once secondary container 12 is fully inserted into recess 14, secondary container 12 is held within recess 14 by friction, and by base 18.

Referring to FIGS. 6, 7, 8, 9, 10, and 11, another embodiment of the invention is shown including a bottle 50, having a central, axially located chamber 52 which is sized and shaped to snugly receive a secondary container 54, not from the side as in the above-described embodiment, but from an access opening 56 located at a lower face 58 of bottle 50. Secondary container 54 preferably includes a cap 60 which may be selectively opened to allow the filling of secondary container 54 with an appropriate liquid.

Access opening 56 of bottle 50 preferably includes threading 62 which is sized and shaped to engage with threading 64 located on a closure 66. Closure 66 further includes a recessed, but accessible handle 68 which allows a user to grip closure 66 and selectively rotate it with respect to bottle 50 to either open access opening 56 or close it.

According to another related embodiment, closure 66 includes an appropriate seal, such as a circumferentially located O-ring which effectively seals chamber 52 upon engagement with threading 62, 64. In this manner, a chilled or heated liquid may be introduced directly into chamber 52, without requiring secondary container 54.

Figure 16:
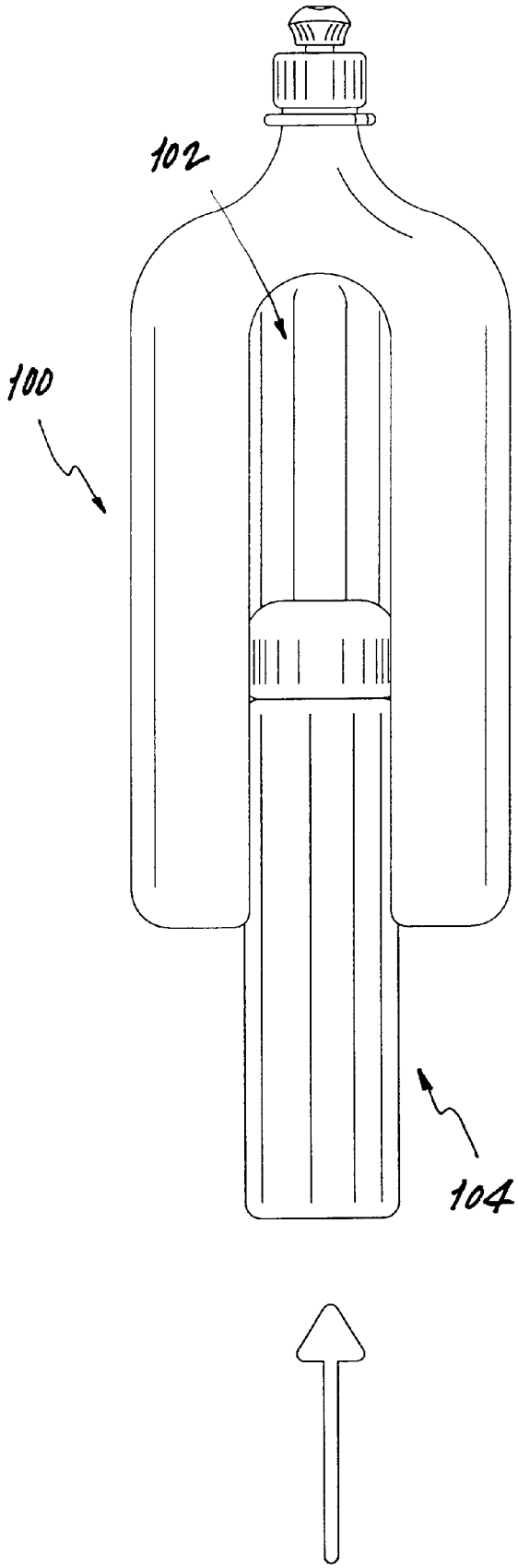
FIG. 16 is a side view of the drinking bottle, showing the thermal-regulating container being inserted into the recess of the drinking bottle, according to the third embodiment of the invention.

Referring to FIGS. 12, 13, 14, and 15, another embodiment of the invention is shown including a bottle 100, having a recess 102 which is positioned along the side wall of bottle 100 and is sized and shaped to snugly receive a secondary container 104. This embodiment is essentially identical to the embodiment of FIGS. 1–5, described above, except that no base 18 is used. Instead, secondary container 104 is inserted within recess 102 through a lower access opening 106, shown in FIGS. 15 and 16. Once inserted, secondary container 104 is retained within recess 102 through the resilient friction imparted by the walls 115 of bottle 100 adjacent to recess 102. In this embodiment, the diameter of recess 102 is preferably slightly smaller than the outer diameter of secondary container 104 ensuring that sufficient friction will exist to hold secondary container 104 within recess 102. To remove secondary container 104 from recess 102, secondary container 104 is pushed downwardly from the top and removed from the lower access opening 106.

While the invention has been described and illustrated with reference to certain preferred embodiments thereof, those skilled in the art will appreciate that various changes, modifications and substitutions can be made therein without departing from the spirit and scope of the invention. For example, the secondary container in any of the above embodiments does not have to be a thermally regulating container. The secondary container may be, for example, a container of bottled water or even non-potable fluid, where the bottle, for example, is a bottle of soda so that the seller can include a sample of one product while selling another. It is intended, therefore, that the invention be limited only by the scope of the claims which follow and that such claims be interpreted as broadly as is reasonable.

What is claimed is:

1. A thermally-regulated bottle, comprising:

a generally cylindrical body portion defining a first chamber for containing a drinking fluid and defining a central longitudinal axis;

a passage for accessing said drinking fluid;

a secondary thermal-regulating container adapted to contain a thermal regulating material; and a recess formed within said body, said recess being positioned generally parallel to and remote from said central longitudinal axis, along the side of said bottle, said recess being sized and shaped to selectively receive said secondary thermal regulating container so that said thermal-regulating material may thermally interact with said drinking fluid within said chamber, a diameter of said recess is smaller than an outer diameter of said secondary thermal-regulating container.

2. The thermally-regulated bottle according to claim 1, wherein said secondary thermal-regulating container is no larger than about ⅓ the size of said body.

3. The thermally-regulated bottle according to claim 1, wherein said recess has a pair of side walls that define an access opening having a width that is smaller than a width of said secondary thermal-regulating container.

4. The thermally-regulated bottle according to claim 3, further comprising a cupped base connected to said body at one end of said body.

5. The thermally-regulated bottle according to claim 4, wherein said cupped base has a relatively flat bottom and a generally cylindrical side wall.

6. The thermally-regulated bottle according to claim 5, wherein a portion of said side wall covers an end portion of said access opening of said recess.

7. A bottle comprising:

a generally cylindrical body portion defining a first chamber for containing a drinking fluid and defining a central longitudinal axis;

a passage for accessing said drinking fluid;

a secondary container; and a recess formed within said body, said recess being positioned generally parallel to and remote from said central longitudinal axis, along the side of said bottle, said recess being sized and shaped to selectively receive said secondary container, a diameter of said recess is smaller than an outer diameter of said secondary thermal regulating container.

8. The bottle according to claim 7, wherein said secondary container is no larger than about ⅓ the size of said body.

9. The bottle according to claim 7, wherein said recess has a pair of side walls that define an access opening having a width that is smaller than a width of said secondary container.

10. The bottle according to claim 9, further comprising a cupped base connected to said body at one end of said body.

11. The bottle according to claim 10, wherein said cupped base has a relatively flat bottom and a generally cylindrical side wall.

12. The bottle according to claim 11, wherein a portion of said side wall covers an end portion of said access opening of said recess.

* * * * *